United States Patent [19]

Moellman et al.

[11] 4,318,363

[45] Mar. 9, 1982

[54] LABORATORY PESTICIDE SPRAY CHAMBER

[75] Inventors: Emanuel E. Moellman, El Cerrito; Jacqueline L. Robertson, Petaluma, both of Calif.

[73] Assignee: The United States of America as represented by the Secretary of Agriculture, Washington, D.C.

[21] Appl. No.: 37,242

[22] Filed: May 9, 1979

[51] Int. Cl.[3] ..... B05B 10/04

[52] U.S. Cl. ..... 118/699; 427/4; 118/326; 118/DIG. 7; 118/320; 422/100; 239/350

[58] Field of Search ..... 118/320, 326, 699; 98/115 B; 427/214; 239/350; 422/99, 100

[56] References Cited

U.S. PATENT DOCUMENTS

| | | | |
|---|---|---|---|
| 1,611,756 | 12/1926 | Leigh | 118/320 |
| 2,064,726 | 12/1936 | Brown | 239/350 |
| 2,557,243 | 6/1951 | Woosley | 239/350 |
| 3,811,409 | 5/1974 | Porter | 118/326 |

FOREIGN PATENT DOCUMENTS

| | | | |
|---|---|---|---|
| 705333 | 3/1965 | Canada | 98/115 B |

OTHER PUBLICATIONS

Potter, Am. Appl. Biol. 39:1 (1952).

Robertson et al., USDA Forest Service Research Note PSW-335, 1/79.

*Primary Examiner*—Sam Silverberg

*Attorney, Agent, or Firm*—M. Howard Silverstein; David G. McConnell

[57] ABSTRACT

An enclosed spray chamber for the application of toxic compounds in micro liquid volumes as a function of time using air as a carrier. The spray chamber is cylindrical and vertically mounted about its longitudinal axis. A spray nozzle is mounted in the top of the spray chamber which uses a syringe and needle reservoir system as an accurate means of controlling the amount of solute dissipated. An air pump provides a stream of air that passes in front of the spray nozzle which pulls the spray solute and solvent out of the syringe by vacuum. An exhaust fan and exhaust outlet are provided to safely dispose of the spray solute and solvent outside of the working area of the chamber. A timer system operates the exhaust fan and air pump so that spray droplet fallout and impingement time can be varied and calibrated. The chamber further has a side door, a rotating specimen table that can be adjusted in height with respect to the spray nozzle, and a funnel shaped bottom with a drain outlet to facilitate cleaning the chamber. A preferred method of operation of the chamber is also described.

4 Claims, 3 Drawing Figures

LABORATORY PESTICIDE SPRAY CHAMBER

BACKGROUND OF THE INVENTION

1. Field of the Invention

This device is used in experimental studies where a known amount of solute and/or solvent need to be evenly distributed over a specimen for a given time, allowed to settle on the specimen for a given period, and then evacuated. The chamber is for spraying potted trees, insects, glass plates, and any other impingement device that the chamber will accommodate. Data obtained from sprayed targets is used to compare chemical efficacy, studies on the physics of spray droplets, chemical residue analysis, photo-oxidation evaluations, pesticide biodegradation studies, dye tracer analysis, and evaluations of various chemical formulations.

2. Description of the Prior Art

This invention is the result of the applicants' dissatisfaction with the ease of cleaning and decontamination of the inner surfaces of present chambers, the inaccuracy and nonuniformity of the amount and pattern of solutes and solvents sprayed, and the limited and inaccurate manner in which the fallout and impingement time could be regulated. Applicants' timber system accurately controls the length of time the air pump operates and the duration of time between which the air pump stops and the exhaust fan begins operation. The rotating spray table and larger chamber size cause greater turbulence of the sprayed materials inside applicants' chamber and make the distribution of such materials much more uniform. Furthermore, the funnel shaped bottom of the chamber and drain system allow quick and easy cleaning of the chamber without disassembly.

Other examples of spray chamber technology may be found in *Annals of Applied Biology* 26:348 and 39:1, and the *Journal of Econ. Entomol.* 61:1122. Applicants' believe that structural differences in their chamber provides significant advantages over the prior art and therefore that their invention is unique and useful in the art of micro liquid volume spray chambers.

SUMMARY OF THE INVENTION

There are several unique features of this micro liquid volume spray chamber which arise from its structure and components. For example, the funnel shaped bottom of the chamber allows easy cleaning without disassembly of the spray chamber. Cleaning solvent may be sprayed with the spray nozzle which washes out the chamber. The waste cleaning solvent then collects in the funnel shaped bottom of the chamber, and may be removed by the drain system. In this way several experiments can be run consecutively without the time consuming disassembly of the chamber for cleaning between each experiment.

The spray nozzle in combination with the syringe and needle reservoir system allow accurate delivery of a specific concentration in to the spray chamber. The amount of solute passing into the spray nozzle can be quantified in micro liquid volumes with this method and apparatus. Normally, with common spray nozzle units, solute sits in a reservoir and is aspirated into the nozzle by a siphon tube. The use of the syringe eliminates this problem and provides for an accurate measurement.

The specimen table in the spray chamber rotates at a variable speed and can be adjusted in height to vary the distance between the specimen and the spray nozzle.

Also, the larger size of this chamber over other chambers allows for greater turbulence of the spray which is important when spraying small trees or objects which vary in height. These features provide a more uniform spray distribution pattern than is possible in conventional spray chambers.

A timer system, which is accurate to one second and can be varied up to an hour controls the length of time the compressor supplies air to the spray nozzle. This period is defined as the fallout time. The timer system also governs the duration of time between which the compressor stops and the solute ceases to be applied, and the exhaust fan begins to evacuate the ambient air from inside the chamber. This period is defined as the impingement time. The precise variation of the fallout and impingement time allows the experimentor to simulate various application conditions which provide optimum results or which may be found in actual on site use. The exhaust fan also allows the experimentor to open the door of the chamber to remove the specimen without contaminating the work area because air will tend to flow into instead of out of the chamber. Also, the timers and control switches are explosion proof so volatile materials may be sprayed safely.

DETAILED DESCRIPTION OF THE PREFERRED EMBODIMENTS

The object of this spray chamber is to provide uniform application of toxic compounds safely in micro liquid volumes as a function of time using air as a carrier. Several different components of this appratus contribute to the achievement of this goal. These components will generally be described as the chamber configuration, the turntable assembly, the spray nozzle assembly, and the timer system. Following the description of these components is a preferred method of operation of the apparatus and data showing the results achieveable with this invention.

CHAMBER CONFIGURATION

Figure 3:
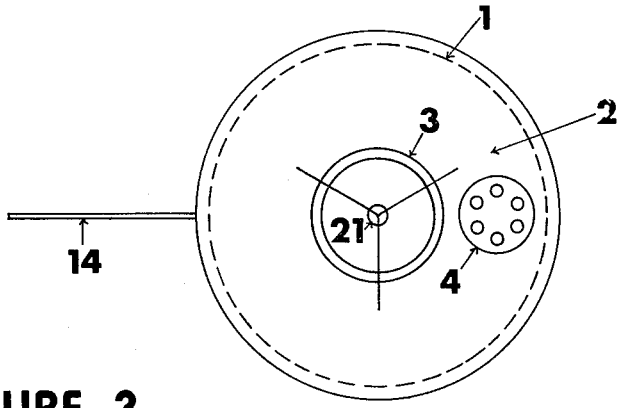
FIG. 3, is a top view of the spray chamber. Note the vent in the top of the chamber. Through this vent passes the incoming air which is used to purge the air in the chamber and end the impingement period.
Figure 1:
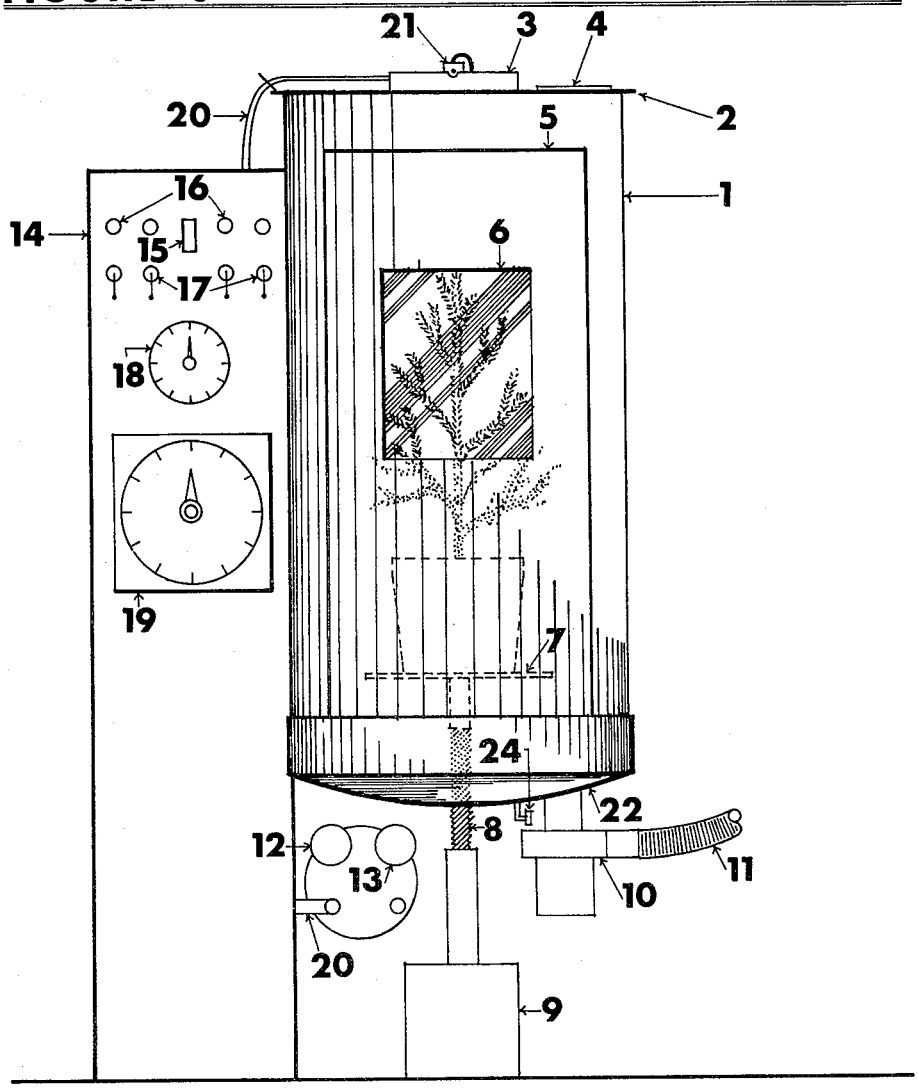
FIG. 1, is a front view of the spray chamber, showing the control panel, the funnel shaped bottom of the chamber, the specimen table and turntable motor, and the position of the air pump exhaust fan.

The chamber (1) of this spray chamber is composed of an enclosed hollow body. This hollow body is formed from a cylinder of approximately 18 inches in diameter and 36 inches high which is capped on both ends as shown in FIG. 1. This size allows greater turbulence within the spray chamber and a more uniform spray solute and solvent distribution. The lid (2) caps the top end of the cylinder and contains a ring (3) which holds the Potter Spray Nozzle (21) used in combination with the syringe reservoir system shown in FIG. 2. The lid (2) also contains a vent (4) which remains open during the chamber's use. The funnel shaped floor (22) of the chamber is used for collecting cleaning fluids and other disposable residues. These fluids may then be withdrawn from the spray chamber through the drain (24) in the floor (22) of the spray chamber. The chamber is also made of stainless steel to allow easy cleaning and corrosion resistance to chemical compounds.

The exhaust fan (10) is mounted in the floor of the spray chamber and is used for venting unwanted vapors away from the work area through a flexible tube (11). An air pump (12) and vacuum pump (13) may be mounted underneath the spray chamber for convenience and to provide a supply of air to the Potter Nozzle (21) through air supply tube (20). The cylinder (1) contains a door (5) which permits the removal and introduction of specimens into the spray chamber. The spraying process can be witnessed through a window (6) in the door (5).

This completes the basic spray chamber configuration.

TURNTABLE ASSEMBLY

The turntable assembly extends through the floor (22) into the spray chamber and is composed of a specimen table (7), a turntable stem (8), a right angle drive unit (23), and turntable motor (9). The turntable may be rotated at a variable speed through controls on the instrument panel (14). The height of the specimen table (7) with respect to the Potter Spray Nozzle (21) may be adjusted by turning the threaded turntable stem (8) in the right angle drive unit (23). Variation of turntable rotation speed and specimen table height allow a more even distribution of spray material on different sizes and types of specimens.

SPRAY NOZZLE ASSEMBLY

Figure 2:
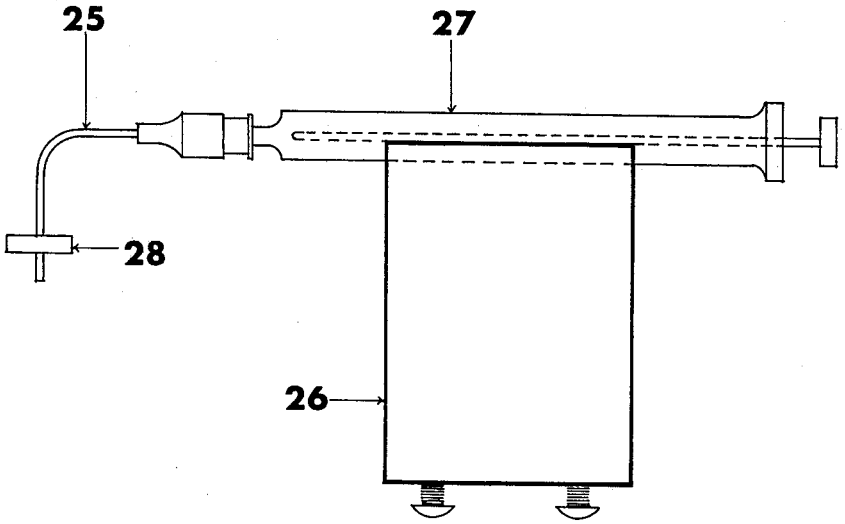
FIG. 2, is a detailed view of the syringe and needle arrangement in combination with the Potter Spray Nozzle.

The spray nozzle assembly is mounted in the lid (2) of the spray chamber and is shown in detail in FIG. 2. The Potter Spray Nozzle (21), a nozzle developed specifically for the application of micro liquid volumes of spray materials in small spray chambers (see *Ann. Appl. Biol.* 39:1, 1952), is fed by a syringe needle reservoir system shown in FIG. 2. Mounting block (26) mounts to the lid (4) of the chamber (1) to provide a fixture for the syringe (27). The syringe needle (25) and adapter (28) fit into the Potter Spray Nozzle (21). The air line (20) is connected to the Potter Spray Nozzle (21). When solute is sprayed the air passing through the Potter Spray Nozzle (21) pulls the spray solute and solvent out of the syringe (27) by vacuum. This method avoids problems of mechanical drive ratchet systems which distribute the material to be sprayed. Such systems must also be adjusted manometrically whereas this spray chamber may be constantly vented to the atmosphere by vent (4) in the lid (2) or by the exhaust fan outlet hose (11). The use of a syringe eliminates the problem of solute and solvent remaining on the sides of standard cavity reservoirs and provides greater accuracy to the system. Also, by changing the size of the needle (25) different amounts of material to be sprayed may be dissipated over a given period.

SWITCH AND TIMER SYSTEM

The timer system is composed of two timers which are accurate to one second and variable up to one hour in duration. The spray timer (19) controls the duration for which the air compressor (12) is in operation and therefore the time over which the material to be sprayed is pulled from the syringe (27) by the venturi effect of the Potter Spray Nozzle (21). This period is called the fallout time. By changing the duration of the air supply from the compressor (12), the amount of air, and the size of the syringe needle (25), an infinite variety of impingement periods and quantities of solute distributed can be arranged. Exhaust timer (18) controls the length of time between which the air compressor (12) stops and when the exhaust fan (10) begins operation. This is called the impingement time. This period allows the spray to settle on the specimen for a desired period before the exhaust fan begins to remove the ambient air of the chamber containing the spray and replacing it with outside air entering the chamber through vent (4). The use of the exhaust fan (10) allows the door (5) of the chamber (1) to be opened without contaminating the work area.

A main switch (15) acts as a main power cutoff to the control panel (14) for safety, and fuses (16) protect the apparatus from electrical overloads. Control switches (17) control the power to the turntable motor (9), exhaust fan (10), air compressor (12) and vacuum pump (13). The control panel is explosion proof thus allowing the safe use of volitile spray substances.

METHOD OF OPERATION

A typical sequence of steps in operating the spray chamber when the target is to be exposed to the spray for sixty seconds before evacuation of the vapors is as follows (FIG. 1):

First: The spray chamber is plugged into a 100 volt AC outlet, the desired volume added to the syringe reservoir system, and the specimen turntable (7) is adjusted to the desired height.

Second: The object to be sprayed is placed on the specimen table and the door (5) securely closed.

Third: The main poser switch (15) is turned on.

Fourth: The exhaust timer (18) is set to fifty seconds and the spray timer (19) to ten seconds.

Fifth: This arrangement results in a ten second atomization time with a fifty second delay before activation of the exhaust pump.

Sixth: The exhaust timer, air pump, and turntable switches (17) on control panel (14) are turned on.

Seventh: The spray timer switch (19) is turned to "On", and the air pump remains on for ten seconds at ten psi.

Eighth: The operator then turns the spray timer switch to "Off".

Ninth: The exhaust pump will come on automatically fifty seconds after the air pump shuts off, and will remain on until the air pump is activated in the next spray cycle.

Tenth: Air pressure within the chamber is equalized with ambient air pressure by opening the vent (4). The necessity for an elaborate manometer system has thus been eliminated.

We claim:

1. An apparatus comprising:

a. an essentially completely enclosed chamber having a door through which an object to be sprayed is introduced into said chamber;

b. a spraying means mounted in the top of said chamber for spraying toxic liquids onto the object within said chamber, said spraying means comprising:

aa. a venturi-type nozzle capable of spraying uniform micro-amounts of liquids;

bb. a syringe and needle liquid delivery means connected to said venturi-type nozzle, said liquid delivery means being capable of delivering precise liquid amounts to said nozzle;

cc. air supply means connected to said venturi-type nozzle capable of supplying air under pressure sufficient to pull liquid from said liquid delivery means when the air passes through said venturi-type nozzle;

c. purging means comprising an openable vent mounted in the top of said chamber and an exhaust fan mounted in the bottom of the chamber.

2. An apparatus as defined in claim 1 which further comprises:

a. a first timing means for controlling fallout time;

b. a second timing means for controlling impingment time.

3. An apparatus as defined in claim 2 which further comprises a specimen table mounted inside the chamber and having a means to rotate said table and a means to adjust the distance between said table and the venturi-type nozzle.

4. An apparatus as defined in claim 3 wherein the chamber has a funnel shaped bottom, and a drain system connected to said funnel shaped bottom.

* * * * *